US011680348B1

(12) United States Patent
Grandt

(10) Patent No.: US 11,680,348 B1
(45) Date of Patent: Jun. 20, 2023

(54) CLOTHES WASHING AND DRYING MACHINE

(71) Applicant: Ricardo Grandt, Hyde Park, MA (US)

(72) Inventor: Ricardo Grandt, Hyde Park, MA (US)

( * ) Notice: Subject to any disclaimer, the term of this patent is extended or adjusted under 35 U.S.C. 154(b) by 198 days.

(21) Appl. No.: 17/171,055

(22) Filed: Feb. 9, 2021

(51) Int. Cl.

| | |
|---|---|
| ***D06F 29/00*** | (2006.01) |
| ***D06F 95/00*** | (2006.01) |
| ***D06F 33/50*** | (2020.01) |
| ***D06F 105/44*** | (2020.01) |
| ***D06F 103/68*** | (2020.01) |
| ***D06F 103/04*** | (2020.01) |

(52) U.S. Cl.
CPC ..... *D06F 29/005* (2013.01); *D06F 33/50* (2020.02); *D06F 95/00* (2013.01); *D06F 2103/04* (2020.02); *D06F 2103/68* (2020.02); *D06F 2105/44* (2020.02)

(58) Field of Classification Search
CPC ..... D06F 29/005; D06F 2103/04; D06F 58/00–52
See application file for complete search history.

(56) References Cited

U.S. PATENT DOCUMENTS

| | | | | |
|---|---|---|---|---|
| D367,135 | S | 2/1996 | Jackovin | |
| 6,481,248 | B2 | 11/2002 | Willis | |
| 6,671,978 | B1 | 1/2004 | McGowan | |
| 6,978,556 | B1 * | 12/2005 | Cornelious | D06F 29/005 34/527 |
| 7,320,234 | B2 | 1/2008 | Hershey | |
| 7,404,303 | B1 * | 7/2008 | Barbosa | D06F 37/04 68/3 R |
| 10,458,054 | B1 * | 10/2019 | Hamilton | D06F 31/00 |
| 11,242,632 | B1 * | 2/2022 | Zeru | D06F 39/12 |
| 2018/0209084 | A1 | 7/2018 | Chakravarty | |
| 2018/0291545 | A1 * | 10/2018 | Jones | D06F 34/05 |
| 2020/0024794 | A1 * | 1/2020 | Pattarello | D06F 58/34 |
| 2020/0370221 | A1 * | 11/2020 | Jones | D06F 29/005 |
| 2022/0127771 | A1 * | 4/2022 | Allen | D06F 29/005 |

FOREIGN PATENT DOCUMENTS

| | | |
|---|---|---|
| WO | 2018136816 | 7/2018 |

* cited by examiner

*Primary Examiner* — Spencer E. Bell
(74) *Attorney, Agent, or Firm* — Kyle A. Fletcher, Esq.

(57) ABSTRACT

The clothes washing and drying machine comprises a washing machine, a drying machine, a chute structure, and a control circuit. The washing machine, the drying machine, and the chute structure are interconnected to form a composite prism structure. The control circuit controls the operation of the clothes washing, the drying machine, and the chute structure. The washing machine is in a superior position relative to the chute structure and the drying machine. The drying machine is in an inferior position relative to the chute structure and the washing machine. The chute structure is in an intermediate position relative to the washing machine and the drying machine. The chute structure forms a channel that allows clothes to fall from the washing machine to the drying machine when: a) the washing machine has completed its operating cycle; while simultaneously, b) the drying machine does not contain clothing.

15 Claims, 5 Drawing Sheets

CLOTHES WASHING AND DRYING MACHINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of textiles including the laundering of textiles, more specifically, a combination of a washing machine with a dryer in a common frame. (D06F29/005)

SUMMARY OF INVENTION

The clothes washing and drying machine comprises a washing machine, a drying machine, a chute structure, and a control circuit. The washing machine, the drying machine, and the chute structure are interconnected to form a composite prism structure. The control circuit controls the operation of the clothes washing, the drying machine, and the chute structure. The washing machine is in a superior position relative to the chute structure and the drying machine. The drying machine is in an inferior position relative to the chute structure and the washing machine. The chute structure is in an intermediate position relative to the washing machine and the drying machine. The washing machine is configured for use in washing clothes. The drying machine is configured for use in drying clothes. The chute structure forms a channel that allows clothes to fall from the washing machine to the drying machine when: a) the washing machine has completed its operating cycle; while simultaneously, b) the drying machine does not contain clothing.

These together with additional objects, features and advantages of the clothes washing and drying machine will be readily apparent to those of ordinary skill in the art upon reading the following detailed description of the presently preferred, but nonetheless illustrative, embodiments when taken in conjunction with the accompanying drawings.

In this respect, before explaining the current embodiments of the clothes washing and drying machine in detail, it is to be understood that the clothes washing and drying machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the clothes washing and drying machine.

It is therefore important that the claims be regarded as including such equivalent construction insofar as they do not depart from the spirit and scope of the clothes washing and drying machine. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
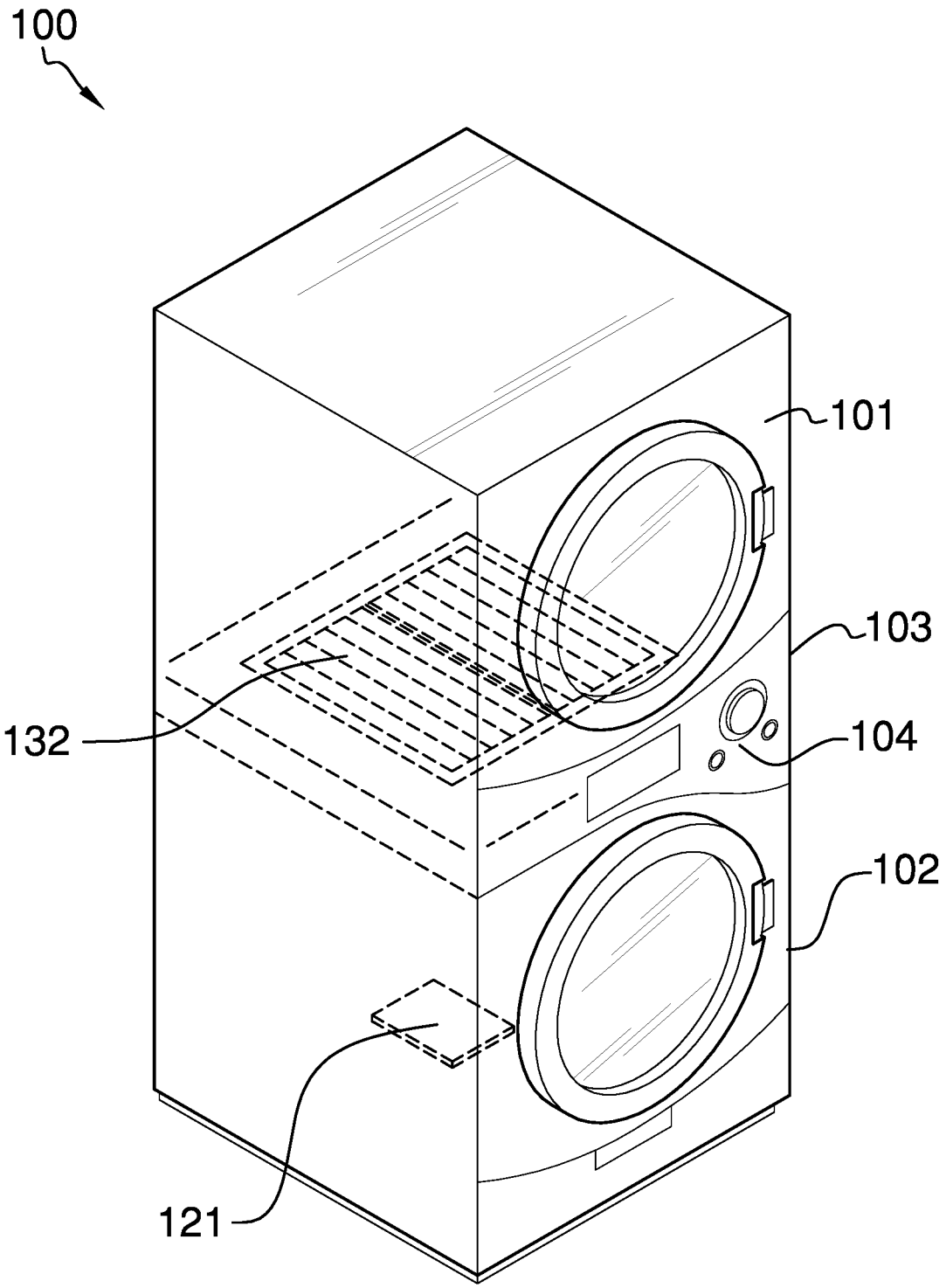
FIG. 1 is a perspective view of an embodiment of the disclosure.
Figure 2:
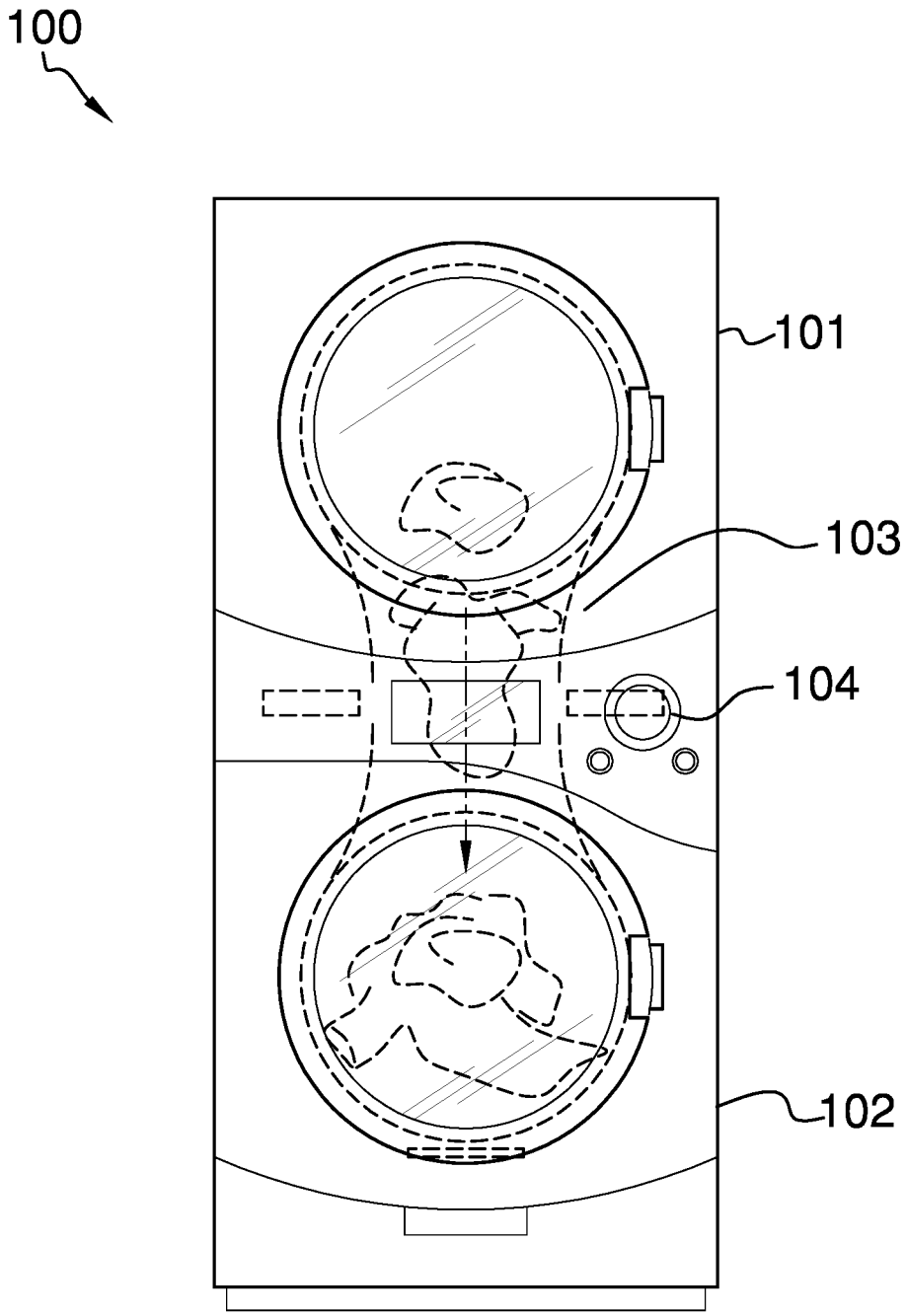
FIG. 2 is a front view of an embodiment of the disclosure.
Figure 3:
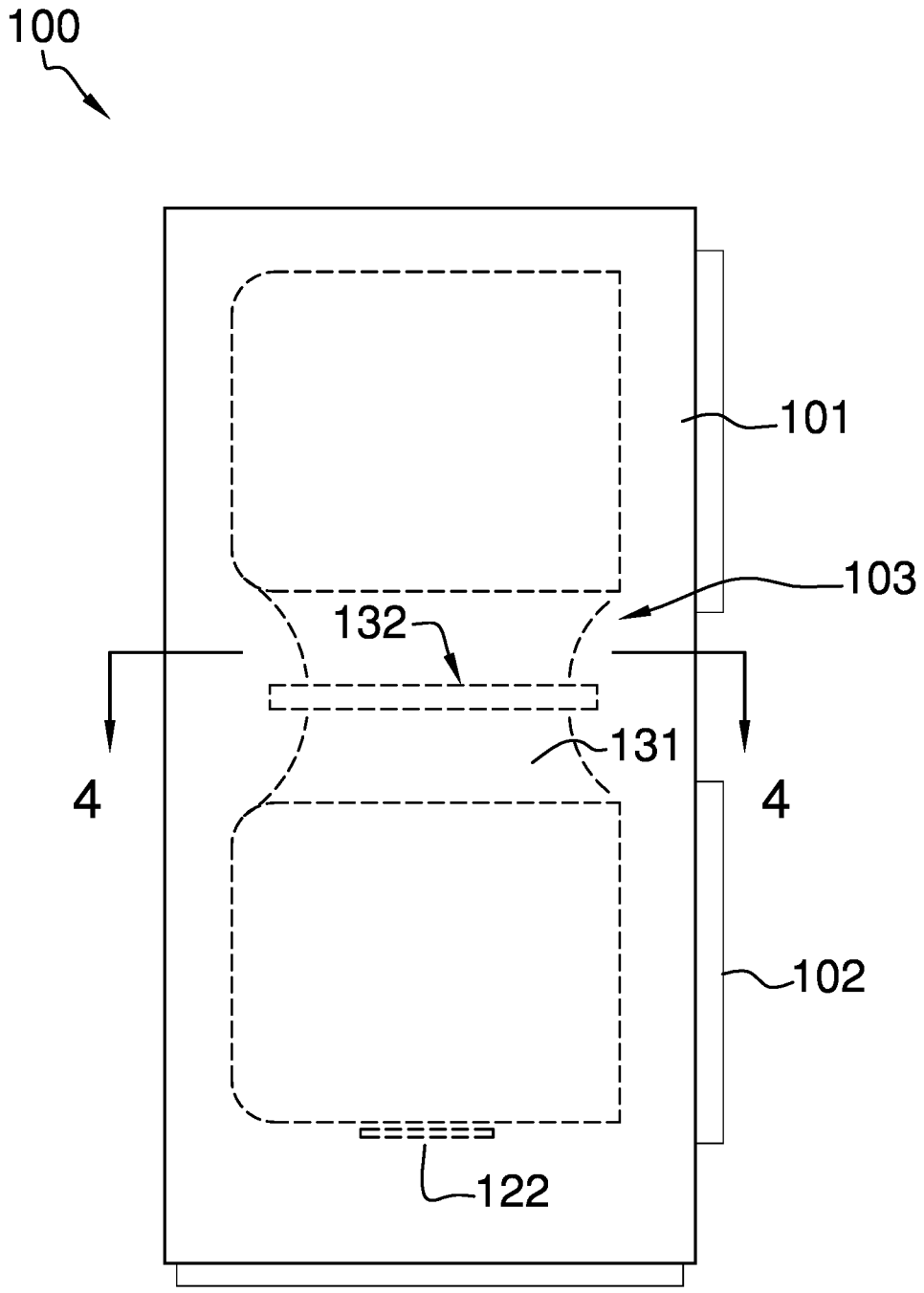
FIG. 3 is a side view of an embodiment of the disclosure.
Figure 4:
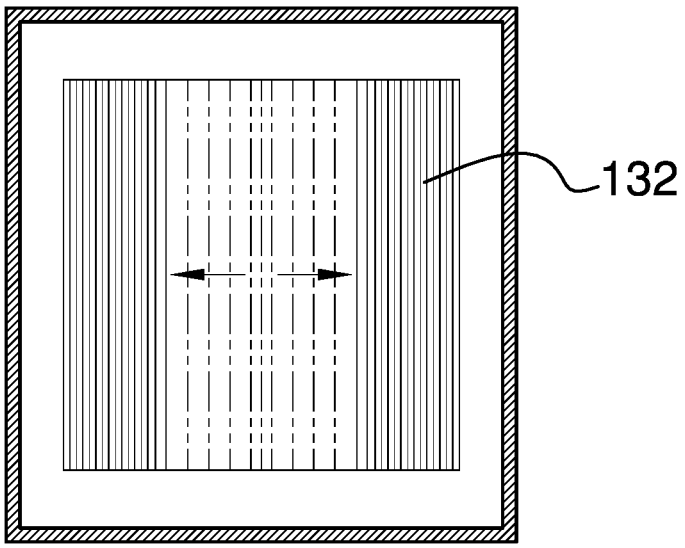
FIG. 4 is an in-use view of an embodiment of the disclosure.
Figure 5:
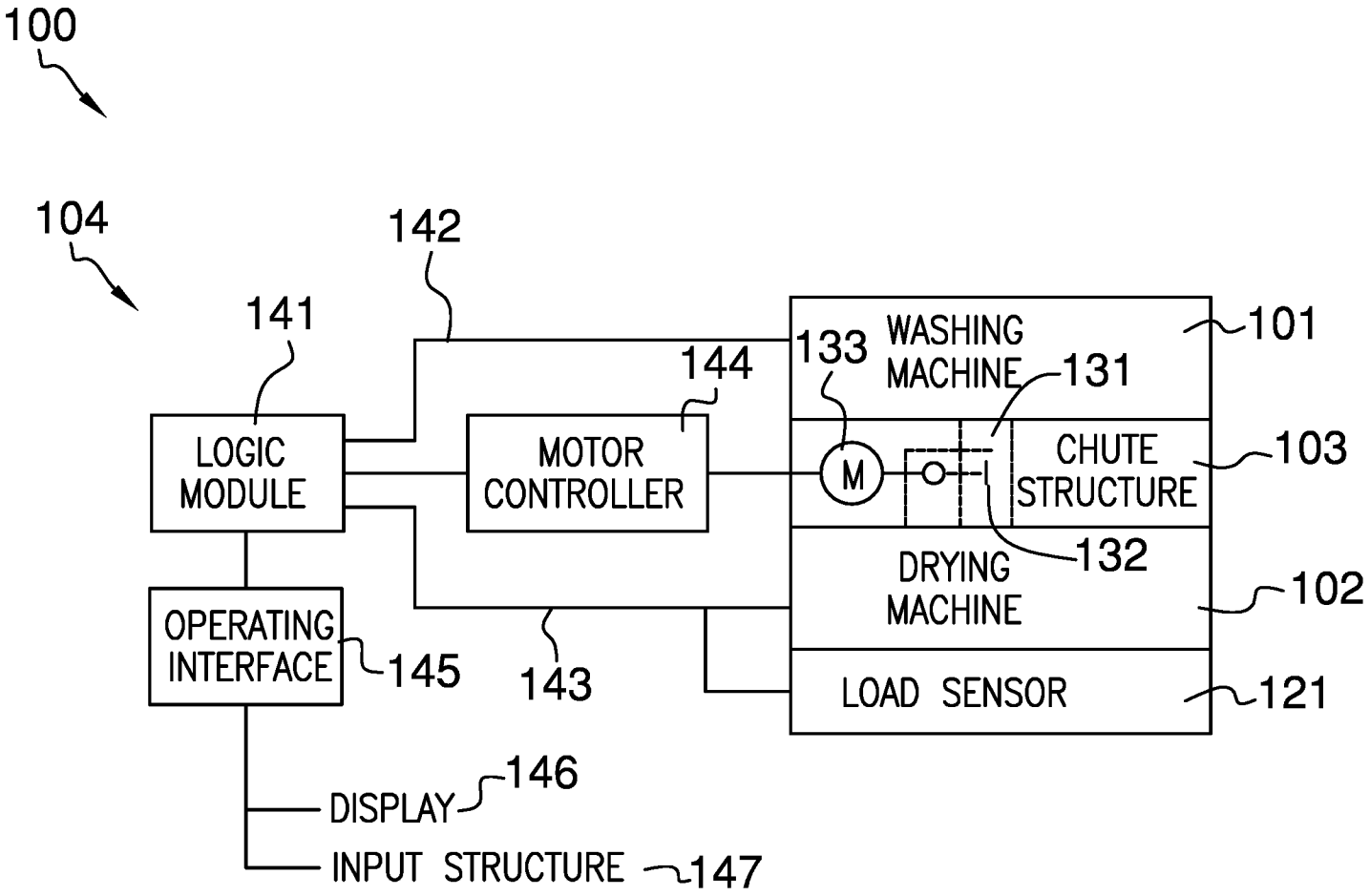
FIG. 5 is a schematic view of an embodiment of the disclosure.

Detailed reference will now be made to one or more potential embodiments of the disclosure, which are illustrated in FIGS. 1 through 5.

The clothes washing and drying machine 100 (hereinafter invention) comprises a washing machine 101, a drying machine 102, a chute structure 103, and a control circuit 104. The washing machine 101, the drying machine 102, and the chute structure 103 are interconnected to form a composite prism structure. The control circuit 104 controls the operation of the clothes washing, the drying machine 102, and the chute structure 103. The washing machine 101 is in a superior position relative to the chute structure 103 and the drying machine 102. The drying machine 102 is in an inferior position relative to the chute structure 103 and the washing machine 101. The chute structure 103 is in an intermediate position relative to the washing machine 101 and the drying machine 102. The washing machine 101 is configured for use in washing clothes. The drying machine 102 is configured for use in drying clothes. The chute structure 103 forms a channel that allows clothes to fall from the washing machine 101 to the drying machine 102 when: a) the washing machine 101 has completed its operating cycle; while simultaneously, b) the drying machine 102 does not contain clothing.

The washing machine 101 is a prism-shaped device. The washing machine 101 has a rectangular block shape. The washing machine 101 is a mechanical device. The washing machine 101 is an electrically powered device. The control circuit 104 controls the operation of the washing machine 101. The washing machine 101 is configured for use in cleaning clothing. The washing machine 101 forms a connection with the chute structure such that the washing machine 101 will discharge the clothing contained in the washing machine 101 into the chute structure 103 after the washing of the clothing is complete.

The drying machine 102 is a prism-shaped device. The drying machine 102 has a rectangular block shape. The drying machine 102 is geometrically identical to the washing machine 101. The drying machine 102 is an electrically powered device. The control circuit 104 controls the operation of the drying machine 102. The drying machine 102 is configured for use in drying clothing after they have been washed in the washing machine 101. The control circuit 104 senses when a load of clothing is contained in drying machine 102. The drying machine receives clothing from the chute structure 103 when the control circuit 104 determines that: a) the drying machine 102 does not contain a load of clothing; and, b) the control circuit 104 senses that the washing machine 101 has completed a washing cycle for a load of clothing.

The drying machine 102 further comprises a load sensor 121. The load sensor 121 is a force sensor. The load sensor 121 mounts in the drying machine 102 such that the load sensor 121 detects when a load of clothing is contained in the drying machine 102. The control circuit 104 monitors the load sensor to determine if there is a load of clothing in the drying machine 102. The control circuit 104 has an interlock in place that prevents the transfer of a load of clothing from the washing machine 101 to the drying machine 102 when the load sensor 121 detects that a load of clothing is in the drying machine 102.

The chute structure 103 is a prism-shaped device. The chute structure 103 is a tubular structure. The chute structure has a rectangular block shape. The chute structure 103 is an electrically powered device. The control circuit 104 controls the operation of the chute structure 103. The chute structure 103 attaches to the washing machine 101 to form a composite prism structure. The chute structure 103 attaches to the drying machine 102 such that the washing machine 101, the drying machine 102, and the chute structure 103 forms a composite prism structure.

The chute structure 103 forms a channel between the washing machine 101 and the drying machine 102. The channel from the chute structure 103 transports the load of clothing contained in the washing machine 101 to the drying machine 102. The chute structure 103 uses gravity to transport the load of clothing contained in the washing machine 101 to the drying machine 102.

The chute structure 103 further comprises an open position and a closed position. The control circuit 104 puts the chute structure 103 into an open position in preparation for transporting a load of clothing from the washing machine 101 to the drying machine 102. The control circuit 104 puts the chute structure 103 back into the closed position after transferring the load of clothing from the washing machine 101 to the drying machine 102.

The chute structure 103 comprises a chute channel 131, a chute door 132, and a chute motor 133.

The chute channel 131 is a negative space that is formed through the chute structure 103. The chute channel 131 is a prism-shaped structure. The center axis of the chute channel aligns with the center axis formed by the composite prism structure formed by the washing machine 101, the drying machine 102, and the chute structure 103. The chute channel 131 forms the physical chute that guides the load of clothing from the washing machine 101 to the drying machine 102. The chute channel 131 forms a passage with the washing machine 101 that allows the chute channel 131 to receive a new load of clothing from the washing machine 101. The chute channel 131 forms a passage with the drying machine 102 that allows the chute channel 131 to deposit a new load of clothing into the drying machine 102.

The chute door 132 is a disk-shaped structure. The chute door 132 forms a barrier that blocks passage through the chute channel 131 of the chute structure 103. The chute door 132 is a flexible structure. The chute door 132 is a fluid impermeable structure. The chute door 132 is formed as a kerf bending. The kerf bending is defined elsewhere in this disclosure. The control circuit 104 controls the position of the chute door 132. The control circuit 104 positions the chute door 132 such that passage through the chute channel 131 is blocked when the chute structure 103 is in a closed position. The chute door 132 positions the chute door 132 such that passage through the chute channel 131 is enabled when the chute structure 103 is in an open position.

The chute motor 133 is an electric motor. The control circuit 104 controls the operation of the chute motor 133. The control circuit 104 uses the chute motor 133 to change the position of the chute door 132 along a track. The control circuit 104 uses the chute motor 133 to deploy the chute door to form a barrier across the chute channel 131 to put the chute structure 103 into the closed position. The control circuit 104 uses the chute motor 133 to retract the chute door away from the chute channel 131 to put the chute structure into the open position. The kerf bending structure of the chute door 132 allows the chute motor 133 to retract the chute door 132 onto a spool to save space.

The control circuit 104 is an electric circuit. The control circuit 104 controls the operation of the washing machine 101. The control circuit 104 controls the operation of the drying machine 102. The control circuit 104 controls the operation of the chute structure 103. The control circuit 104 coordinates the operation of the washing machine 101 with the chute structure 103. The control circuit 104 coordinates the operation of the drying machine 102 with the chute structure 103.

By coordinating the operation of the washing machine 101 with the chute structure 103 is meant that the control circuit 104: a) enables the washing machine 101 to release its load of clothing into the chute structure 103; b) enables the chute structure 103 to receive the load of clothing and to transport the load of clothing from the washing machine 101 to the drying machine 102 by setting the chute structure 103 into the open position; and then subsequently, c) enables the washing machine 101 to receive a new load of clothing.

By coordinating the operation of the drying machine 102 with the chute structure 103 is meant that the control circuit 104: d) enables the drying machine 102 to receive a load of clothing from the chute structure 103; e) resets the chute structure 103 into a closed position after transferring the load of clothing into the drying machine 102; and, f) enables the drying machine 102 to dry the newly received load of clothing.

The control circuit 104 comprises a logic module 141, a washing machine 101 communication link 142, a drying machine 102 communication link 143, a chute motor 133 controller 144, and an operating interface 145. The logic module 141, the washing machine 101 communication link 142, the drying machine 102 communication link 143, the chute motor 133 controller 144, and the operating interface 145 are electrically interconnected.

The logic module 141 is an electric circuit. The logic module 141 is a programmable circuit. The logic module 141 controls the operation of the washing machine 101. The logic module 141 controls the operation of the drying machine 102. The logic module 141 controls the operation of the chute structure 103. The logic module 141 controls the operation of the chute motor 133 controller 144. The logic module 141 controls the operation of the operating interface 145.

The logic module 141 coordinates the operation of the washing machine 101 with the chute structure 103. The logic module 141 coordinates the operation of the drying machine 102 with the chute structure 103.

By coordinating the operation of the washing machine 101 with the chute structure 103 is meant that the logic module 141: a) enables the washing machine 101 to release its load of clothing into the chute structure 103; b) enables the chute structure 103 to receive the load of clothing and to transport the load of clothing from the washing machine 101 to the drying machine 102 by setting the chute structure 103 into the open position; and then subsequently, c) enables the washing machine to receive a new load of clothing.

By coordinating the operation of the drying machine 102 with the chute structure 103 is meant that the logic module 141: d) enables the drying machine 102 to receive a load of clothing from the chute structure 103; e) resets the chute structure 103 into a closed position after transferring the load of clothing into the drying machine 102; and, f) enables the drying machine to dry the newly received load of clothing.

The washing machine 101 communication link 142 is a communication link between the logic module 141 and the washing machine 101. The logic module 141 uses the washing machine 101 communication link 142 to control and coordinate the operation of the washing machine 101. The drying machine 102 communication link 143 is a communication link between the logic module 141 and the drying machine 102. The logic module 141 uses the drying machine 102 communication link 143 to control and coordinate the operation of the drying machine 102.

The chute motor 133 controller 144 is a motor controller. The motor controller is defined elsewhere in this disclosure. The chute motor 133 controller 144 controls the operation of the chute motor 133. By controlling the operation of the chute motor 133 is meant that: a) the chute motor 133 controller 144 controls the direction of rotation of the chute motor 133; and, b) the chute motor 133 controller 144 controls the speed of rotation of the chute motor 133. The chute motor 133 controller receives instructions regarding the direction and speed of rotation of the chute motor 133 from the logic module 141.

The operating interface 145 is the interface structure of the control circuit 104. The operating interface 145 visibly displays relevant information regarding the status and operation of the invention 100. The operating interface 145 receives as input externally provided instructions regarding the operation of the invention 100. The operating interface 145 comprises a display device 146 and an input structure 147. The display device 146 is an electrical device. The logic module 141 controls the operation of the display device 146. The display device 146 visibly displays relevant information regarding the status and operation of the invention 100. The input structure is an electrical device. The input structure 147 controls the operation of the display device 146. The input structure receives as input externally provided instructions regarding the operation of the invention 100. In the first potential embodiment of the disclosure, the functions of the display device 146 and the input structure 147 are performed by a touchscreen display.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a negative space that forms a prism-shaped passage through which an object or fluid passes.

Closed Position: As used in this disclosure, a closed position refers to a movable barrier structure that is in an orientation that prevents passage through a port or an aperture. The closed position is often referred to as an object being "closed."

Chute: As used in this disclosure, a chute refers to a channel that controls the path of motion of an object undergoing a gravity enabled descent to a lower elevation:

Communication Link: As used in this disclosure, a communication link refers to the structured exchange of data between two objects.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Display: As used in this disclosure, a display is a surface upon which is presented an image, potentially including, but not limited to, graphic images and text, that is interpretable by an individual viewing the projected image in a meaningful manner. A display device refers to an electrical device used to present these images.

Door: As used in this disclosure, a door is a movable or removable barrier that is attached to a chamber for the purpose of allowing or preventing access through an aperture into the chamber.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Flexure Bearing: As used in this disclosure, a flexure bearing is a thin and flexible material that is used to attach, or bind, a first object to a second object such that the first object can rotate in a controlled direction relative to the second object.

Force of Gravity: As used in this disclosure, the force of gravity refers to a vector that indicates the direction of the pull of gravity on an object at or near the surface of the earth.

Force Sensor: As used in this disclosure, the force sensor is a sensor that generates an electrically measurable signal that is a function of the amount of force applied to the force sensor. The force sensor is often referred to as a pressure sensor. The force sensor commonly measures force using the piezoelectric effect generated by the deformation of a material.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interface: As used in this disclosure, an interface is a physical or virtual boundary that separates two different systems across which information is exchanged.

Interlock: As used in this disclosure, an interlock is a device that disables the operation of a first mechanism without the enablement of a second mechanism. Generally, an interlock is used as a safety device.

Living Hinge: As used in this disclosure, a living hinge refers to a single object that is formed out of flexible material that is divided into a first segment, a second segment and the living hinge. The flexible nature of the flexible material allows the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Piezoelectric Effect: As used in this disclosure, the piezoelectric effect refers to a class of materials wherein a strain placed upon the material will result in a redistribution of electrons within the material in a manner that causes an electric charge. This electric charge can be measured as a voltage potential across the material. This effect can be reversed in some of these materials such that the application of an AC voltage to the material will cause a vibration within the material. A material commonly used to take advantage of the piezoelectric effect is polyvinylidene difluoride (CAS 24937-79-9) which is also known as PVDF.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Touchscreen Display: As used in this disclosure, a touchscreen display is an interface that allows a user to interface with a logical device by touching the image bearing surface of a display.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Trapdoor: As used in this disclosure, a trapdoor is a door that is oriented such that the object passing through the door travels in the vertical direction.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cleaning apparatus comprising a washing machine, a drying machine, a chute structure, and a control circuit;

wherein the washing machine, the drying machine, and the chute structure are interconnected to form a composite prism structure;

wherein the control circuit controls the operation of the washing machine, the drying machine, and the chute structure;

wherein the washing machine is configured for use in washing clothing;

wherein the drying machine is configured for use in drying clothing;

wherein the chute structure comprises a chute channel, a chute door, and a chute motor;

wherein the chute channel is a negative space that is formed through the chute structure;

wherein the chute door sets the chute structure into a position selected from the group consisting of an open position and a closed position;

wherein the chute motor controls the operation of the chute door;

wherein the chute door is a disk-shaped structure;

wherein the chute door forms a barrier that blocks passage through the chute channel of the chute structure;

wherein the chute door is a flexible structure;

wherein the chute door is a fluid impermeable structure;

wherein the chute door is formed as a kerf bending;

wherein the control circuit controls the position of the chute door;

wherein the control circuit positions the chute door such that passage through the chute channel is blocked when the chute structure is in the closed position;

wherein the control circuit positions the chute door such that passage through the chute channel is enabled when the chute structure is in the open position.

2. The cleaning apparatus according to claim 1 wherein the washing machine is in a superior position relative to the chute structure and the drying machine;

wherein the drying machine is in an inferior position relative to the chute structure and the washing machine;

wherein the chute structure is in an intermediate position relative to the washing machine and the drying machine;

wherein the chute structure forms a channel that allows clothing to fall from the washing machine to the drying machine when: a) the washing machine has completed an operating cycle; while simultaneously, and b) the drying machine does not contain clothing.

3. The cleaning apparatus according to claim 2 wherein the washing machine has a rectangular block shape;

wherein the washing machine is a mechanical device;

wherein the washing machine is an electrically powered device;

wherein the control circuit controls the operation of the washing machine;

wherein the washing machine forms a connection with the chute structure such that the washing machine will enable the clothing contained in the washing machine to fall into the chute structure after the operating cycle is complete.

4. The cleaning apparatus according to claim 3 wherein the drying machine has a rectangular block shape;

wherein the drying machine is geometrically identical to the washing machine;

wherein the drying machine is an electrically powered device;

wherein the control circuit controls the operation of the drying machine;

wherein the drying machine is configured for use in drying clothing after they have been washed in the washing machine;

wherein the control circuit senses when a load of clothing is contained in the drying machine;

wherein the drying machine receives clothing from the chute structure when the control circuit determines that: a) the drying machine does not contain a load of clothing; and, b) the control circuit senses that the washing machine has completed the operating cycle for a load of clothing.

5. The cleaning apparatus according to claim 4 wherein the chute structure is a tubular structure;

wherein the chute structure has a rectangular block shape;

wherein the chute structure is an electrically powered device;

wherein the control circuit controls the operation of the chute structure;

wherein the chute structure attaches to the washing machine to form a composite structure;

wherein the chute structure attaches to the drying machine such that the washing machine, the drying machine, and the chute structure form a composite structure;

wherein the chute structure forms a channel between the washing machine and the drying machine;

wherein the channel of the chute structure transports the load of clothing contained in the washing machine to the drying machine;

wherein the chute structure uses gravity to transport the load of clothing contained in the washing machine to the drying machine;

wherein the control circuit puts the chute structure into the open position in preparation for transporting a load of clothing from the washing machine to the drying machine;

wherein the control circuit puts the chute structure back into the closed position after transferring the load of clothing from the washing machine to the drying machine.

6. The cleaning apparatus according to claim 5 wherein the control circuit is an electric circuit;

wherein the control circuit controls the operation of the washing machine;

wherein the control circuit controls the operation of the drying machine;

wherein the control circuit controls the operation of the chute structure;

wherein the control circuit coordinates the operation of the washing machine with the chute structure;

wherein the control circuit coordinates the operation of the drying machine with the chute structure;

wherein by coordinating the operation of the washing machine with the chute structure is meant that the control circuit: a) enables the washing machine to release its load of clothing into the chute structure; b) enables the chute structure to receive the load of clothing and to transport the load of clothing from the washing machine to the drying machine by setting the chute structure into the open position; and then subsequently, c) enables the washing machine to receive a new load of clothing;

wherein by coordinating the operation of the drying machine with the chute structure is meant that the control circuit: d) enables the drying machine to receive a load of clothing from the chute structure; e) resets the chute structure into the closed position after transferring the load of clothing into the drying machine; and, f) enables the drying machine to dry the newly received load of clothing.

7. The cleaning apparatus according to claim 6 wherein the drying machine further comprises a load sensor;

wherein the load sensor is a force sensor;

wherein the load sensor mounts in the drying machine such that the load sensor detects when a load of clothing is contained in the drying machine;

wherein the control circuit monitors the load sensor to determine if there is a load of clothing in the drying machine;

wherein the control circuit has an interlock in place that prevents the transfer of a load of clothing from the washing machine to the drying machine when the load sensor detects that a load of clothing is in the drying machine.

8. The cleaning apparatus according to claim 7 wherein the control circuit comprises a logic module, a washing machine communication link, a drying machine communication link, a chute motor controller, and an operating interface;

wherein the logic module, the washing machine communication link, the drying machine communication link, the chute motor controller, and the operating interface are electrically interconnected.

9. The cleaning apparatus according to claim 8 wherein the center axis of the chute channel aligns with the center axis formed by the composite structure formed by the washing machine, the drying machine, and the chute structure;

wherein the chute channel forms the physical chute that guides the load of clothing from the washing machine to the drying machine;

wherein the chute channel forms a passage with the washing machine that allows the chute channel to receive a new load of clothing from the washing machine;

wherein the chute channel forms a passage with the drying machine that allows the chute channel to deposit a new load of clothing into the drying machine.

10. The cleaning apparatus according to claim 9 wherein the chute motor is an electric motor;

wherein the control circuit controls the operation of the chute motor;

wherein the control circuit uses the chute motor to change the position of the chute door along a track;

wherein the control circuit uses the chute motor to deploy the chute door to form a barrier across the chute channel to put the chute structure into the closed position;

wherein the control circuit uses the chute motor to retract the chute door away from the chute channel to put the chute structure into the open position.

11. The cleaning apparatus according to claim 10 wherein the logic module is an electric circuit;

wherein the logic module is a programmable circuit;

wherein the logic module controls the operation of the washing machine;

wherein the logic module controls the operation of the drying machine;

wherein the logic module controls the operation of the chute structure;

wherein the logic module controls the operation of the chute motor controller;

wherein the logic module controls the operation of the operating interface;

wherein the logic module coordinates the operation of the washing machine with the chute structure;

wherein the logic module coordinates the operation of the drying machine with the chute structure;

wherein by coordinating the operation of the washing machine with the chute structure is meant that the logic module: a) enables the washing machine to release its load of clothing into the chute structure; b) enables the chute structure to receive the load of clothing and to transport the load of clothing from the washing machine to the drying machine by setting the chute structure into the open position; and then subsequently, c) enables the washing machine to receive a new load of clothing;

wherein by coordinating the operation of the drying machine with the chute structure is meant that the logic module: d) enables the drying machine to receive a load of clothing from the chute structure; e) resets the chute structure into the closed position after transferring the load of clothing into the drying machine; and, f) enables the drying machine to dry the newly received load of clothing.

12. The cleaning apparatus according to claim 11 wherein the washing machine communication link is a communication link between the logic module and the washing machine;

wherein the logic module uses the washing machine communication link to control and coordinate the operation of the washing machine;

wherein the drying machine communication link is a communication link between the logic module and the drying machine;

wherein the logic module uses the drying machine communication link to control and coordinate the operation of the drying machine.

13. The cleaning apparatus according to claim 12 wherein the chute motor controller is a motor controller;

wherein the chute motor controller controls the operation of the chute motor;

wherein by controlling the operation of the chute motor is meant that: a) the chute motor controller controls the direction of rotation of the chute motor; and, b) the chute motor controller controls the speed of rotation of the chute motor;

wherein the chute motor controller receives instructions regarding the direction and speed of rotation of the chute motor from the logic module.

14. The cleaning apparatus according to claim 13 wherein the operating interface is an interface structure of the control circuit;

wherein the operating interface visibly displays relevant information regarding the status and operation of the cleaning apparatus;

wherein the operating interface receives as input externally provided instructions regarding the operation of the cleaning apparatus.

15. The cleaning apparatus according to claim 14 wherein the operating interface comprises a display device and an input structure;

wherein the display device is an electrical device;

wherein the logic module controls the operation of the display device;

wherein the display device visibly displays relevant information regarding the status and operation of the cleaning apparatus;

wherein the input structure is an electrical device;

wherein the input structure controls the operation of the display device;

wherein the input structure receives as input externally provided instructions regarding the operation of the cleaning apparatus.

* * * * *